US008181718B2

(12) United States Patent
Burleson et al.

(10) Patent No.: US 8,181,718 B2
(45) Date of Patent: May 22, 2012

(54) PERFORATING GUN GRAVITATIONAL ORIENTATION SYSTEM

(75) Inventors: John D. Burleson, Denton, TX (US); Flint R. George, Flower Mound, TX (US); John H. Hales, Choctaw, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/008,075

(22) Filed: Jan. 18, 2011

(65) Prior Publication Data

US 2011/0120695 A1 May 26, 2011

Related U.S. Application Data

(63) Continuation of application No. 11/957,541, filed on Dec. 17, 2007.

(51) Int. Cl.
*E21B 43/118* (2006.01)

(52) U.S. Cl. ..... 175/4.51; 89/1.15

(58) Field of Classification Search ..... 175/4.51; 89/1.15

See application file for complete search history.

(56) References Cited

U.S. PATENT DOCUMENTS

| | | | | |
|---|---|---|---|---|
| 2,833,213 | A | 5/1958 | Udry | |
| 2,980,017 | A | 4/1961 | Castel | |
| 3,414,071 | A * | 12/1968 | Alberts | 175/4.51 |
| 3,599,719 | A * | 8/1971 | Brown | 166/297 |
| 4,410,051 | A * | 10/1983 | Daniel et al. | 175/4.51 |
| 4,637,478 | A | 1/1987 | George | |
| 4,830,120 | A * | 5/1989 | Stout | 175/4.51 |
| 5,103,912 | A * | 4/1992 | Flint | 166/297 |
| 5,107,927 | A | 4/1992 | Whiteley et al. | |
| 5,529,127 | A | 6/1996 | Burleson et al. | |
| 5,603,379 | A | 2/1997 | Henke et al. | |
| 5,823,266 | A | 10/1998 | Burleson et al. | |
| 5,957,209 | A | 9/1999 | Burleson et al. | |
| 5,964,294 | A | 10/1999 | Edwards et al. | |
| 5,992,523 | A | 11/1999 | Burleson et al. | |
| 6,595,290 | B2 | 7/2003 | George et al. | |
| 6,679,327 | B2 | 1/2004 | Sloan et al. | |
| 7,000,699 | B2 | 2/2006 | Yang et al. | |
| 7,114,564 | B2 | 10/2006 | Parrott et al. | |
| 2008/0149338 | A1 * | 6/2008 | Goodman et al. | 166/299 |

OTHER PUBLICATIONS

Office Action issued Sep. 8, 2009, for U.S. Appl. No. 11/957,541, 10 pages.
Office Action issued Feb. 2, 2010, for U.S. Appl. No. 11/957,541, 8 pages.
Office Action issued Jul. 15, 2010, for U.S. Appl. No. 11/957,541, 6 pages.
Office Action issued Nov. 22, 2010, for U.S. Appl. No. 11/957,541, 6 pages.
Office Action issued Oct. 24, 2011 for U.S. Appl. No. 11/957,541, 6 pages.
Office Action issued May 4, 2011, for U.S. Appl. No. 11/957,541, 9 pages.

* cited by examiner

*Primary Examiner* — Stephen M Johnson
(74) *Attorney, Agent, or Firm* — Marlin R. Smith

(57) ABSTRACT

A perforating gun gravitational orientation system includes a perforating gun and a swivel device connected to the perforating gun to permit rotation of the perforating gun within casing, and the perforating gun spaced apart from the casing by the swivel device. Another perforating gun gravitational orientation system includes the swivel device having an axis of rotation which is spaced apart from a center of gravity of the perforating gun. Yet another perforating gun gravitational orientation system includes the swivel device having an axis of rotation which is spaced apart from a center axis of the perforating gun.

5 Claims, 10 Drawing Sheets

PERFORATING GUN GRAVITATIONAL ORIENTATION SYSTEM

CROSS-REFERENCE TO RELATED APPLICATION

The present application is a continuation of U.S. application Ser. No. 11/957,541 filed on Dec. 17, 2007. The entire disclosure of this prior application is incorporated herein by this reference.

BACKGROUND

The present invention relates generally to equipment utilized and operations performed in conjunction with subterranean wells and, in an embodiment described herein, more particularly provides a perforating gun gravitational orienting system.

It is sometimes desirable to perforate a well in a particular direction or range of directions relative to the wellbore. For example, in a deviated, inclined or horizontal well it is frequently beneficial to shoot perforating charges in a downward direction. However, certain circumstances may instead make it more beneficial to perforate in an upward direction, in a particular inclination from the upward or downward direction, or in another combination or range of directions.

To achieve this goal of perforating wells in particular directions, several attempts have been made to achieve reliable orientation of perforating charges downhole. Unfortunately, each of these has its drawbacks.

One method of orienting perforating charges downhole requires the charges to be rigidly mounted in a gun carrier so that they are pointed in the desired direction(s) relative to the carrier. The gun carrier is then conveyed into a wellbore and either laterally biased physically to one side of the wellbore so that the gun carrier seeks the lower portion of the wellbore due to gravity, or the gun carrier is rotatably supported with its center of gravity laterally offset relative to the wellbore.

This method relies on the gun carrier rotating in the wellbore, so that the gun carrier may be oriented relative to the force of gravity. Frequently, such orienting rotation is unreliable due to friction between the gun carrier and the wellbore, debris in the wellbore, etc.

Another method of orienting perforating charges rotatably mounts the perforating charges in the gun carrier. The charges are mounted to a structure which extends substantially the length of the gun carrier. Rotating supports are attached at each end of the structure to permit the charges and the structure to rotate within the gun carrier due to gravity. Unfortunately, the structure is somewhat complex to assemble and requires use of non-standard gun components, thereby complicating the logistics of providing the orientation system, and failing to take advantage of economies of scale.

Therefore, it may be seen that an improved oriented perforating system is needed.

SUMMARY

In the present specification, a perforating gun gravitational orientation system is provided which solves at least one problem in the art. One example is described below in which a swivel device permits free rotation of a perforating gun relative to a casing string. Another example is described below in which the swivel device is uniquely designed to connect to a standard perforating gun, and to allow independent rotation of perforating gun assemblies.

In one aspect, a perforating gun gravitational orientation system is provided which includes at least one perforating gun and at least one swivel device connected to the perforating gun to permit rotation of the perforating gun within a casing. The perforating gun is spaced apart from the casing by the swivel device.

In another aspect, a perforating gun gravitational orientation system is provided which includes at least one perforating gun having a center of gravity and at least one swivel device connected to the perforating gun to permit rotation of the perforating gun within a casing. The swivel device has an axis of rotation which is spaced apart from the center of gravity.

In yet another aspect, a perforating gun gravitational orientation system is provided which includes at least one perforating gun having a center axis; and at least one swivel device connected to the perforating gun to permit rotation of the perforating gun within a casing. The swivel device has an axis of rotation which is spaced apart from the gun center axis.

Multiple swivel devices may be connected to multiple perforating guns, with the swivel devices permitting independent rotation of the perforating guns within the casing.

The swivel device may include a pressure isolating bulkhead positioned between two detonation transfer components.

The swivel device may be connected between multiple perforating guns. The perforating gun may be connected between multiple swivel devices.

These and other features, advantages, benefits and objects will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction away from the earth's center or toward the earth's surface along a wellbore, and "below", "lower", "downward" and similar terms refer to a direction toward the earth's center or away from the earth's surface along a wellbore.

Figure 1:
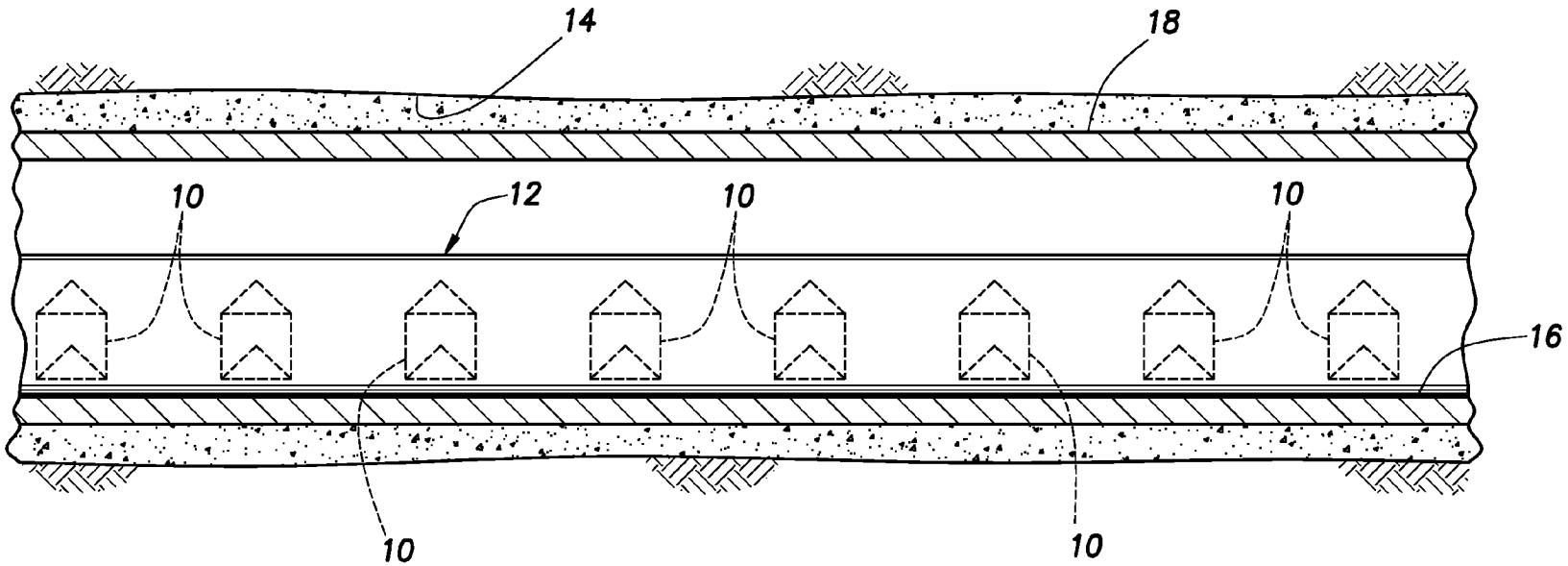
FIG. 1 is a schematic partially cross-sectional view of a perforating gun installed in a casing in a well.

Representatively illustrated in FIG. 1 is a situation in which the principles of the present disclosure may be utilized. In this situation, it is desired to orient perforating charges 10 in a perforating gun 12, so that the charges shoot in a downward direction from a substantially horizontal wellbore 14. In other situations, the wellbore 14 could be inclined or otherwise deviated, and it could be desirable for the charges 10 to shoot in other directions or range of directions.

Unfortunately, the perforating gun 12 is resting against an interior surface 16 of casing 18. Friction due to contact between the perforating gun 12 and the interior surface 16 resists accurate orientation of the charges 10 by prior known methods.

As used herein, the term "casing" indicates any protective wellbore lining, and may include tubular goods known to those skilled in the art as casing, liner or tubing. Casing may be made of any material, such as steel, aluminum, polymers, composites, etc., and may be expandable, formed in a wellbore, or otherwise installed.

Figure 2:
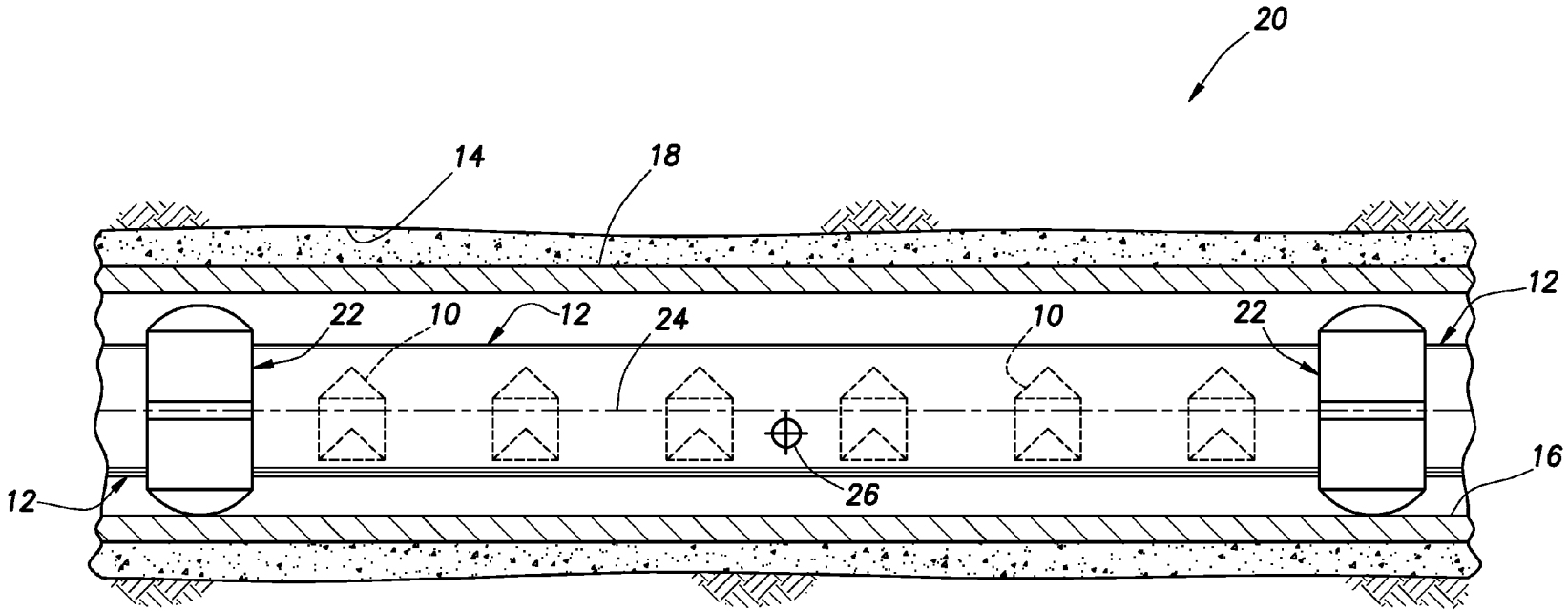
FIG. 2 is a schematic partially cross-sectional view of a gravitational orientation system which may be used with the perforating gun of FIG. 1.

Referring additionally now to FIG. 2, a gravitational orientation system 20 and associated method embodying principles of the present invention are representatively illustrated. In this system 20, the perforating gun 12 is rotatably supported out of contact with the interior surface 16 of the casing 18 by means of swivel devices 22.

Two of the swivel devices 22 are depicted in FIG. 2 as being connected at opposite ends of the perforating gun 12. However, it should be clearly understood that any number of perforating guns 12 could be positioned between the swivel devices 22. The number of perforating guns 12 between the swivel devices 22 is preferably limited to prevent the guns from sagging into contact with the interior surface 16 of the casing 18 between the swivel devices, but it should be understood that any number of perforating guns may be connected between the swivel devices.

Each of the swivel devices 22 is depicted in FIG. 2 as being connected between two perforating guns 12. However, it should be clearly understood that a swivel device 22 can be interconnected between other components, such as a firing head, blank detonation transfer section, work string, etc., in a perforating operation.

The swivel devices 22 permit independent rotation of the perforating guns 12 relative to each other. In this manner, it is not necessary for an entire perforating string to rotate simultaneously, which would require maintaining precise alignment between all adjacent components. Instead, the swivel devices 22 allow each perforating gun 12 (or set of perforating guns, if multiple guns are connected on opposite sides of a swivel device) to rotate as needed to achieve a desired orientation of the charges 10 in each gun.

The perforating guns 12 rotate about an axis of rotation 24 defined by the swivel devices 22. In order for the charges 10 to be properly oriented, a center of gravity 26 of the perforating gun 12 is laterally offset relative to the axis of rotation 24.

As depicted in FIG. 2, the center of gravity 26 is positioned directly below the axis of rotation 24, thereby orienting the charges 10 to shoot in the desired downward direction. If, however, the center of gravity 26 were to be rotated in either direction about the axis 24, a torque due to gravitational force acting on the center of gravity would operate to rotate the perforating gun 12 to the position shown in FIG. 2, in which the center of gravity is directly below the axis of rotation.

The lack of contact between the perforating gun 12 and the interior surface 16 of the casing 18 enables the gravitational torque described above to accurately orient the perforating gun with reduced friction, so that the charges 10 shoot in the desired direction. It is anticipated that the system 20 will permit orientation of the charges 10 with an accuracy of +/−2 degrees, and preferably with an orientation accuracy of +/−1 degree.

Note that, in the configuration of FIG. 2, the axis of rotation 24 is aligned with a center axis of the perforating gun 12. Thus, the perforating gun 12 rotates about its center axis. However, it should be understood that this is not necessary, since the axis of rotation 24 could be offset relative to the center axis of the perforating gun 12, as described for one example below.

Figure 3:
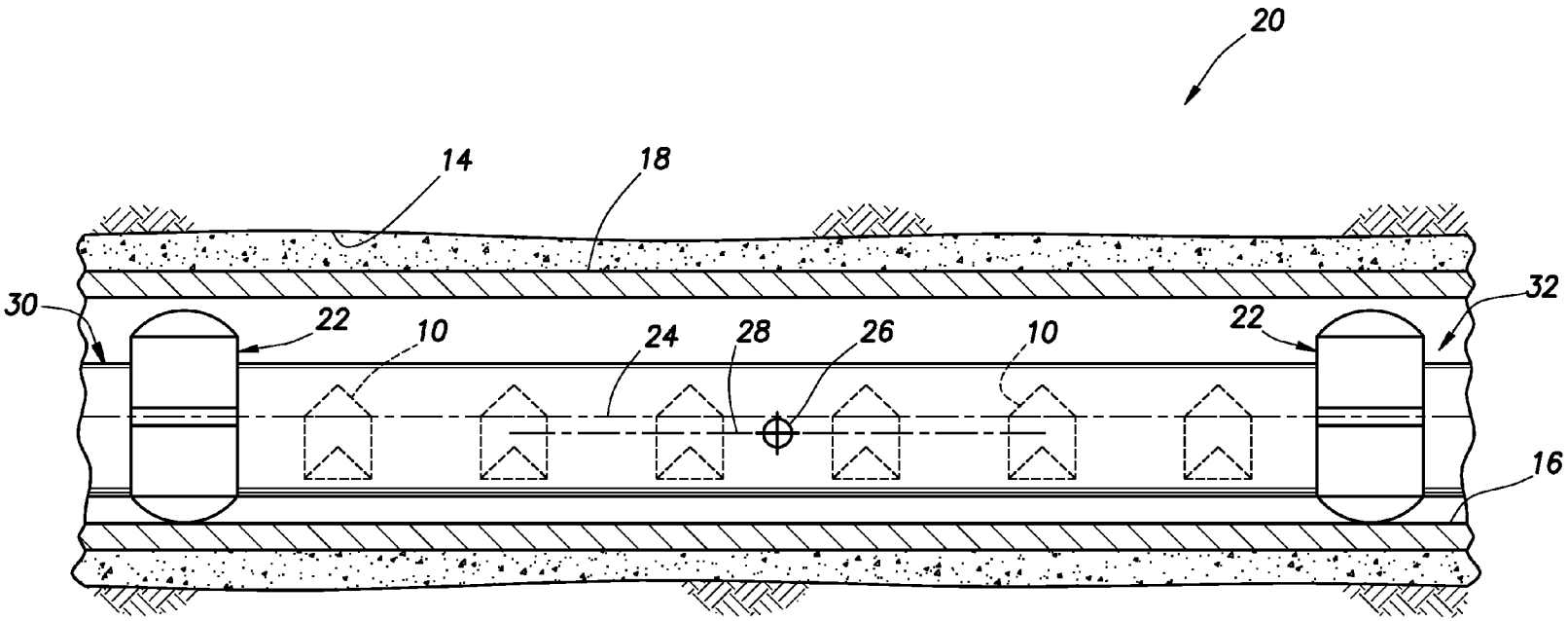
FIG. 3 is a schematic partially cross-sectional view of an alternate configuration of the system of FIG. 2.

Referring additionally now to FIG. 3, an alternate configuration of the system 20 is representatively illustrated. In this configuration, the axis of rotation 24 is laterally offset relative to a center axis 28 of the perforating gun 12.

As depicted in FIG. 3, the center of gravity 26 is positioned along the center axis 28 of the perforating gun 12, but it should be understood that this is not necessary. The center of gravity 26 could be laterally offset relative to the center axis 28, whether or not the center of gravity is also laterally offset relative to the axis of rotation 24, and whether or not the axis of rotation is laterally offset from the center axis.

Another difference in the system 20 of FIG. 3 is that a work string or production string 30 is connected above the upper (left as viewed in FIG. 3) swivel device 22, and a firing head 32 is connected below the lower (right as viewed in FIG. 3) swivel device. This demonstrates that components other than perforating guns may be connected to either end of the swivel devices 22.

Figure 5:
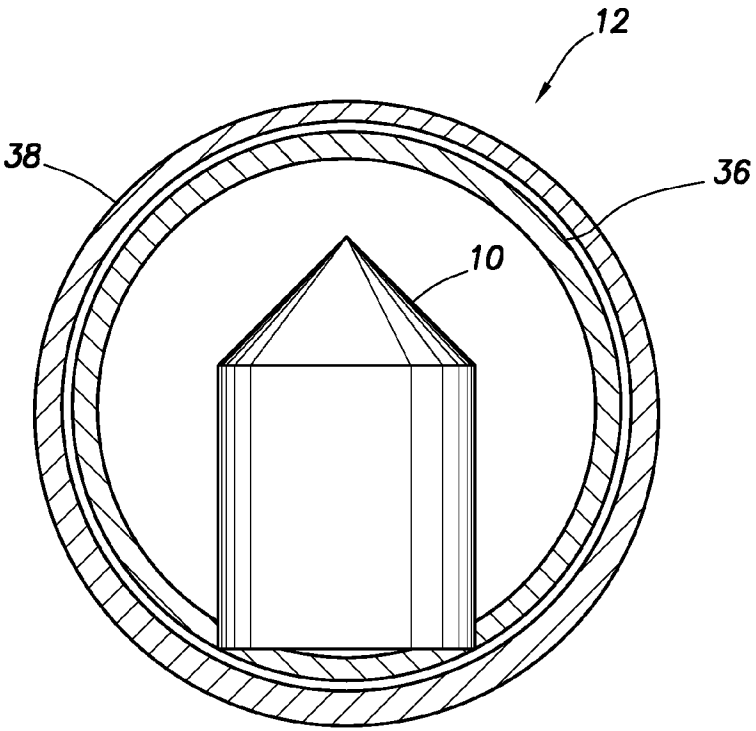
FIG. 5 is a schematic lateral cross-sectional view of an alternate configuration of the perforating gun.
Figure 4:
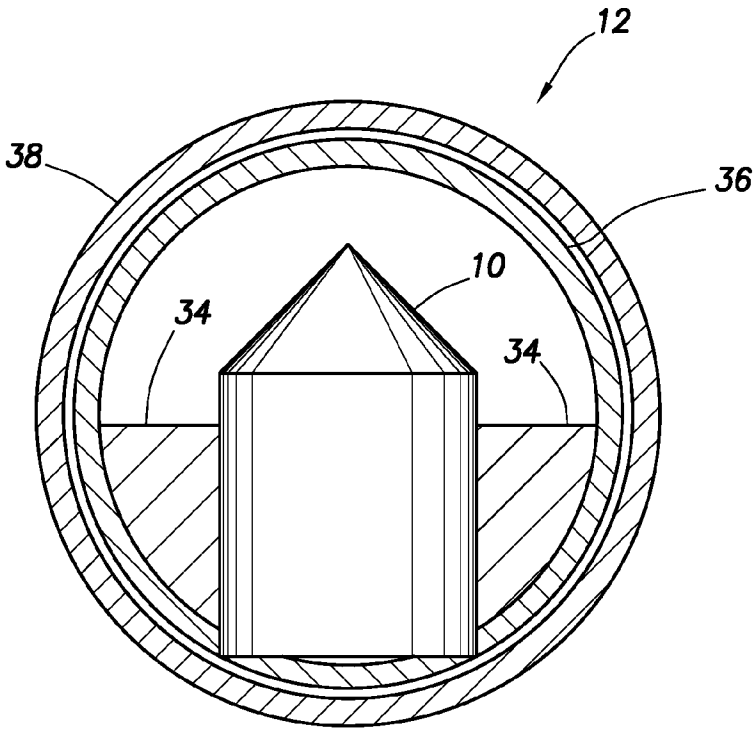
FIG. 4 is an enlarged scale schematic lateral cross-sectional view of the perforating gun.
Figure 6:
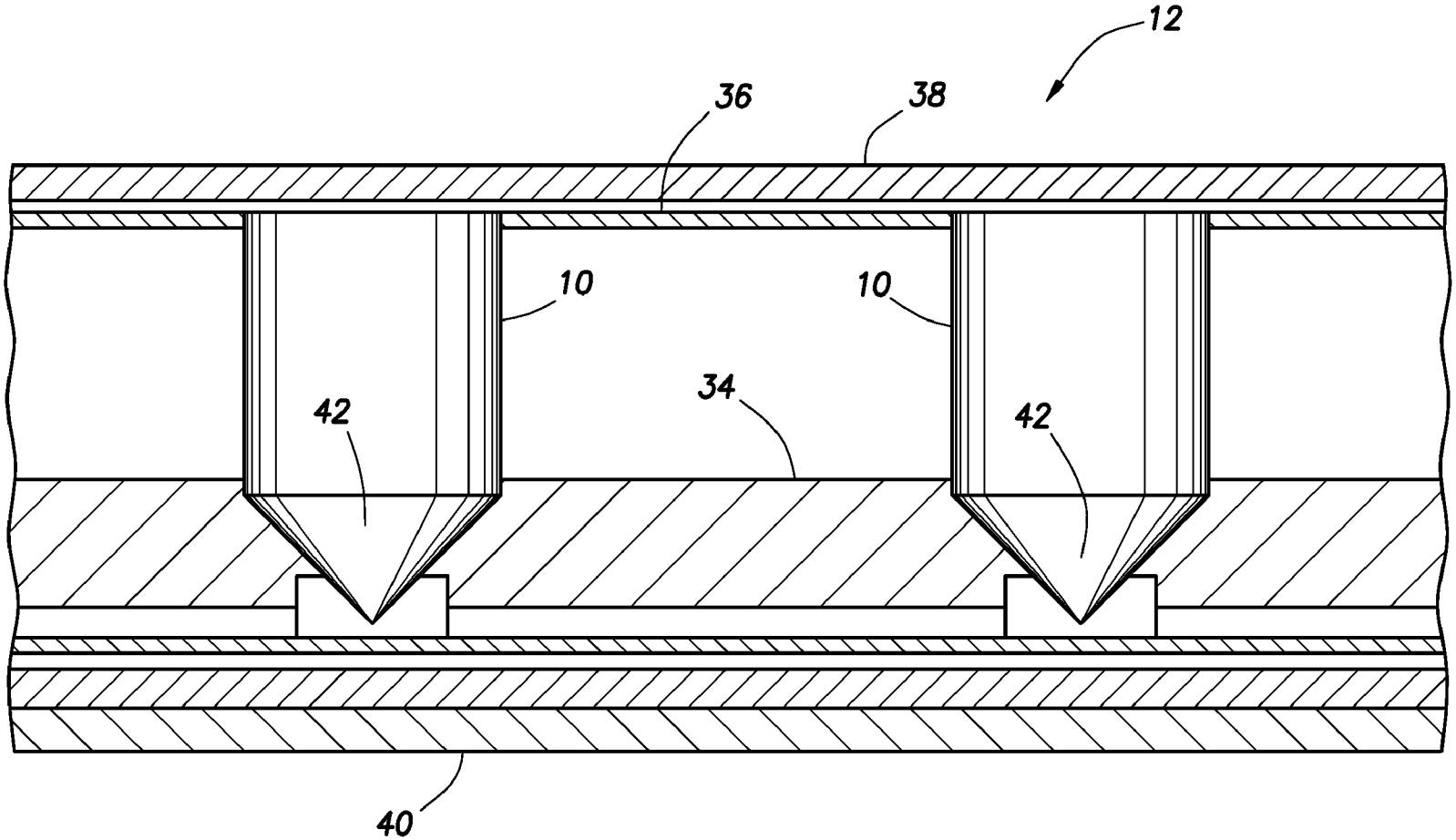
FIG. 6 is a schematic longitudinal cross-sectional view of another alternate configuration of the perforating gun.

FIGS. 4-6 representatively illustrate various techniques for laterally offsetting the center of gravity 26 of the perforating gun 12 in the system 20. Other techniques or combinations of techniques may be used if desired.

In FIG. 4, a weight or weights 34 have been positioned within a tubular charge carrier 36 in a tubular gun body 38 of the perforating gun 12.

In FIG. 5, an inner diameter of the gun body 38 is eccentered relative to an outer diameter of the gun body.

In FIG. 6, the weight 34 is used in the charge carrier 36, and an additional weight bar 40 is attached to an exterior of the gun body 38. In addition, a back end 42 of each perforating charge 10 could provide further weight to influence the position of the center of gravity 26, since in a typical perforating charge the back end weighs more than the front end.

Thus, FIG. 6 demonstrates that a combination of techniques may be used to influence the position of the center of gravity 26. Also, note that in the configuration of FIG. 6 the charges 10 are preferentially oriented in an upward shooting direction although, as discussed above, any orientation of the charges may be used as desired.

Figure 7:
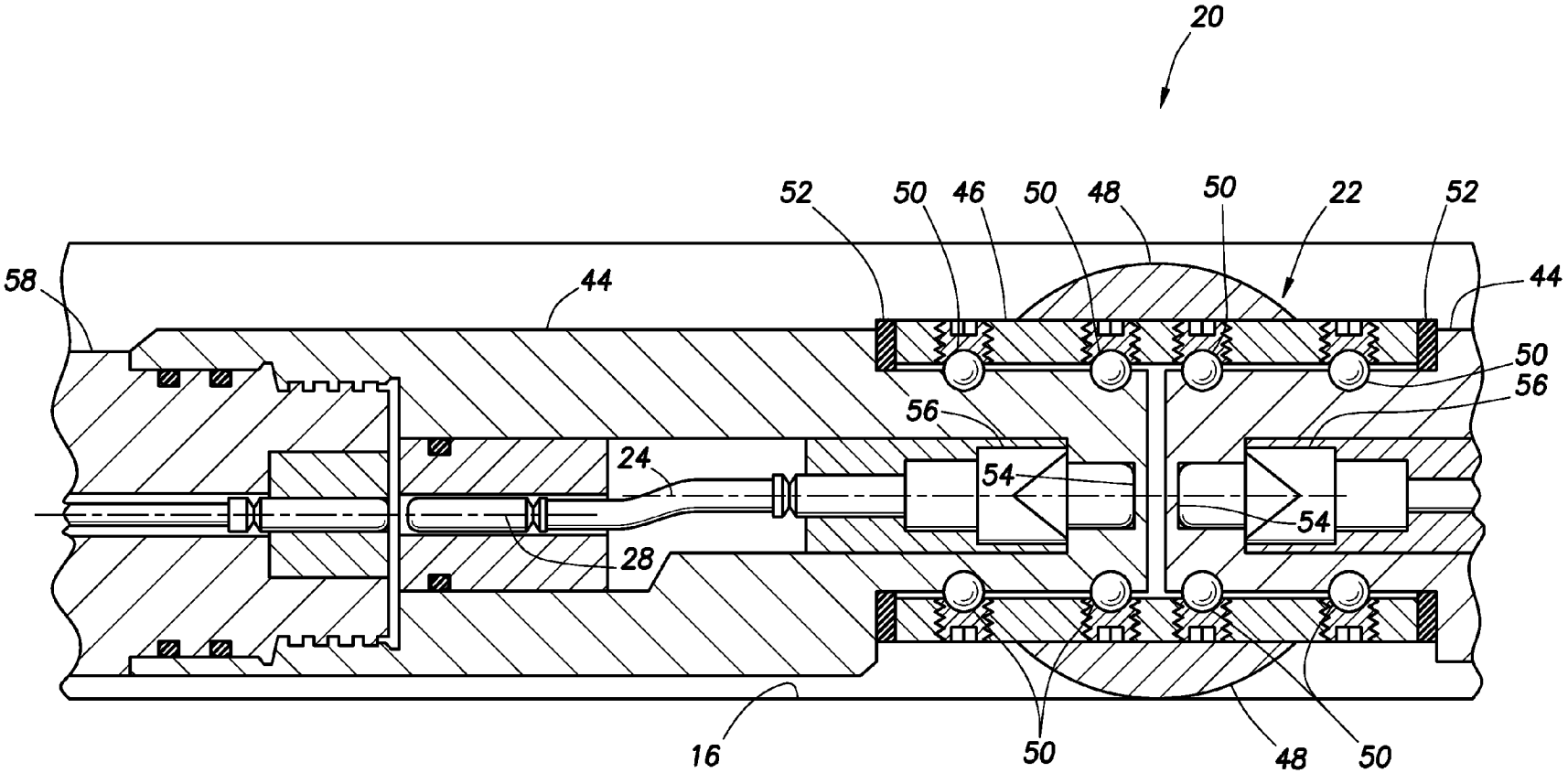
FIG. 7 is a schematic cross-sectional view of a swivel device of the orientation system.

Referring additionally now to FIG. 7, an enlarged scale schematic cross-sectional view of one configuration of the swivel device 22 is representatively illustrated. In this configuration, end connectors 44 of the swivel device 22 are constructed to laterally offset the center axis 28 relative to the axis of rotation 24.

The swivel device 22 includes a central support housing 46 with radially extending fins or flutes 48 thereon to support the perforating gun 12 out of contact with the interior surface 16 of the casing 18. Ball bearings 50 provide for relatively low friction rotation of the end connectors 44 relative to the housing 46.

Note that the end connectors 44 can rotate independently, thus, the opposite ends of the swivel device 22 can rotate relative to each other. This provides for independent rotation of the perforating guns 12, sets of guns, or other components connected to the swivel device 22, without the need to precisely align the components relative to each other.

Debris barriers 52 (e.g., rings made of friction reducing polymer material such as polytetrafluoroethylene) may be used to exclude debris from the bearings 50 and reduce friction between the housing 46 and the end connectors 44. The debris barriers 52 preferably do not provide a pressure seal, since such a seal would be a source of friction between the housing 46 and the end connectors 44.

Instead, pressure isolation is provided by bulkheads 54 in the ends of the connectors 44 positioned within the housing 46. The bulkheads 54 isolate well pressure from explosive detonation transfer components 56 in the connectors 44.

The detonation transfer components 56 are preferably bidirectional and are of the type capable of shooting through the bulkheads 54 to detonate the other detonation transfer component. For this purpose, ends of the detonation transfer components 56 which face each other may be shaped similar to a shaped charge. Such detonation transfer components 56 are well known to those skilled in the art and will not be described further herein.

A connector 58 is depicted in FIG. 7 for connecting the perforating gun 12, production string 30, firing head 32 or other component to the swivel device 22. Similar connectors 58 may be used at each end of the swivel device 22.

Note that the end connectors 44 could be configured so that the center axis 28 is aligned with the axis of rotation 24 if desired.

Figure 8:
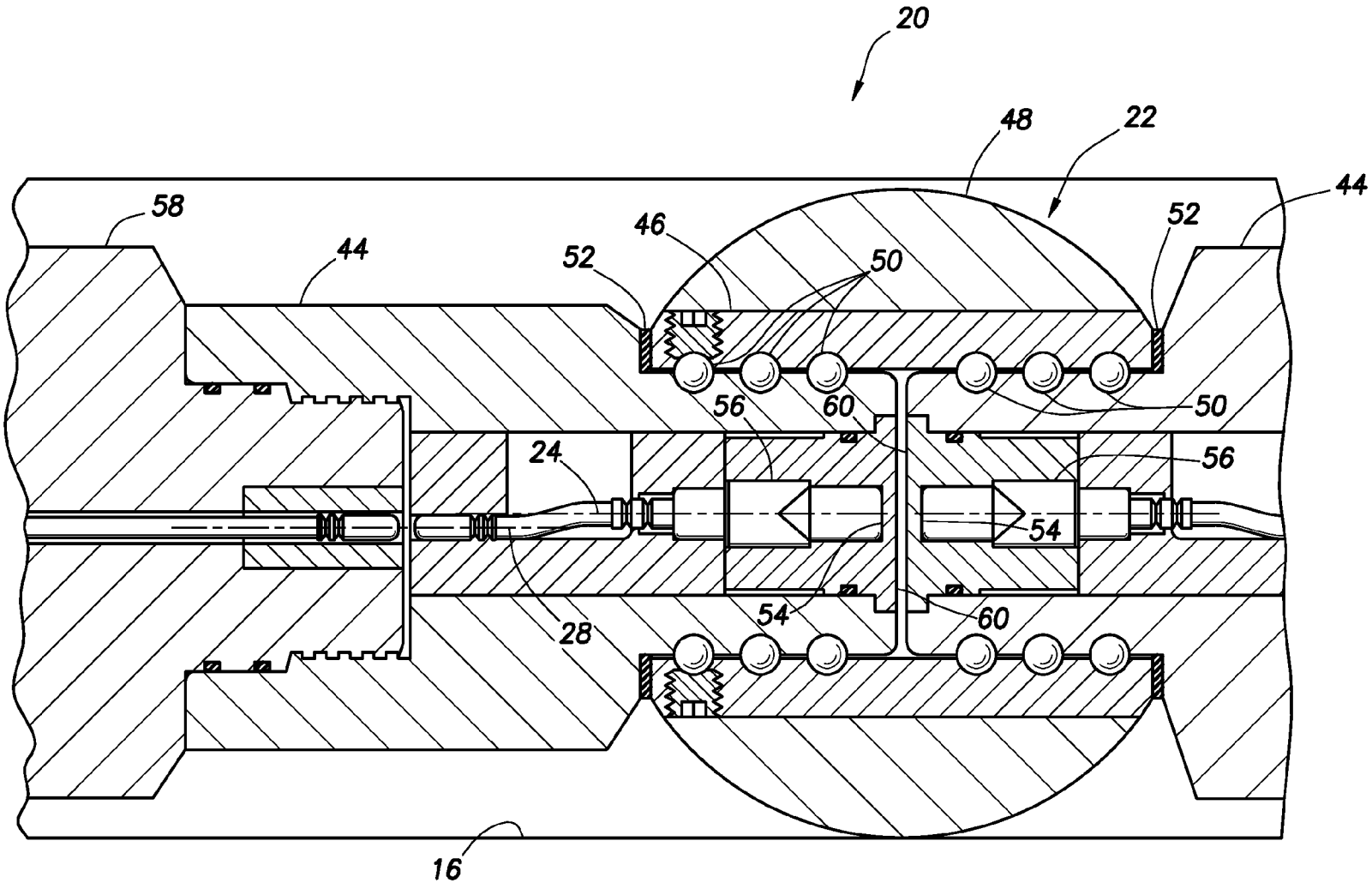
FIG. 8 is a schematic cross-sectional view of an alternate construction of the swivel device.

Referring additionally now to FIG. 8, an alternate configuration of the swivel device 22 is representatively illustrated. In this configuration, the center axis 28 is laterally offset with respect to the center of rotation 24, as with the configuration of FIG. 7. However, note that the pressure isolating bulkheads 54 are formed on separate inserts 60 sealingly installed in the facing ends of the connectors 44.

Figure 9:
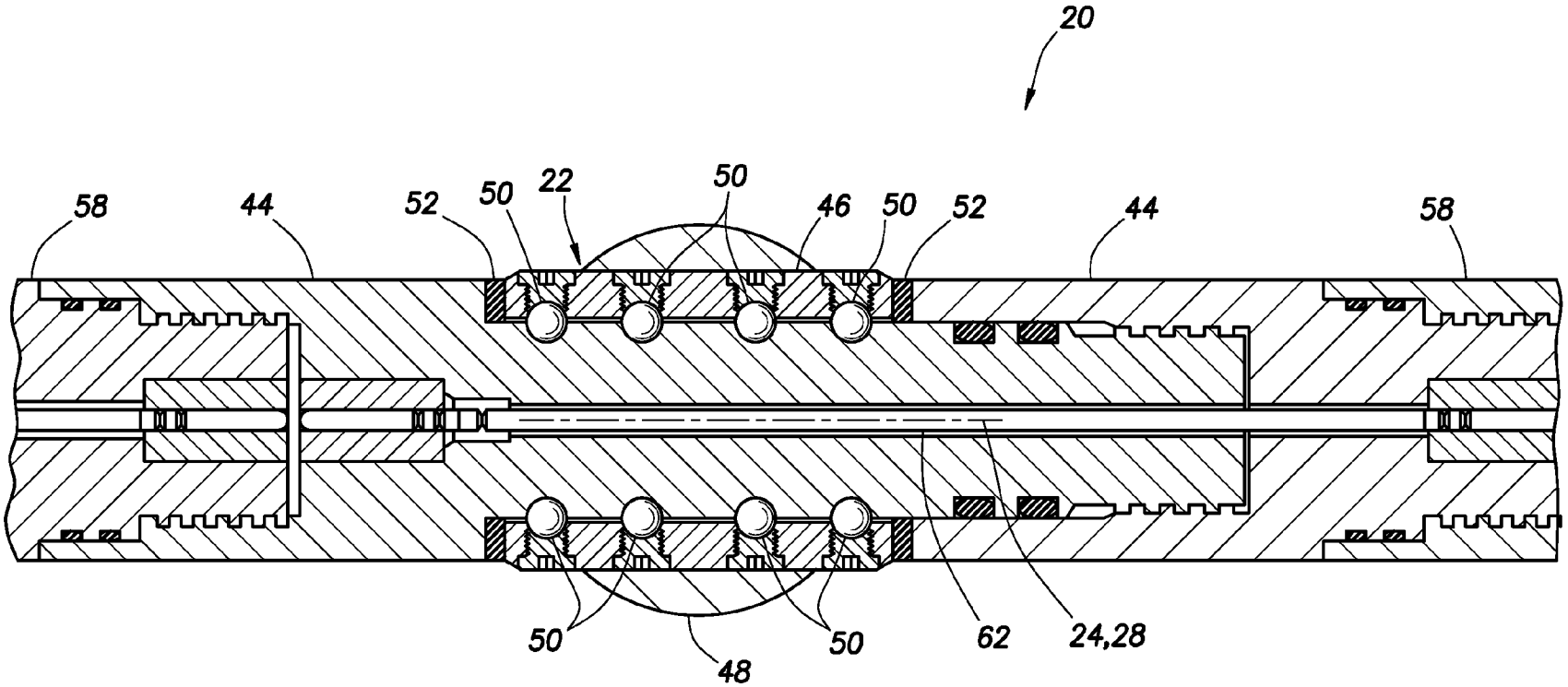
FIG. 9 is a schematic cross-sectional view of another alternate construction of the swivel device.

Referring additionally now to FIG. 9, another alternate configuration of the swivel device 22 is representatively illustrated. In this configuration, the pressure isolating bulkheads 54 are not used between the end connectors 44, and the end connectors do not rotate independently of each other.

Instead, a detonation train 62 extends through the upper end connector 44, which extends through the housing 46. The end connectors 44 are threaded together on a lower end of the housing 46. Precise alignment between the end connectors 44 or the perforating guns 12 connected thereto may be maintained, if desired, using various techniques, such as alignment keys, set screws, shims, etc.

The swivel device 22 configuration of FIG. 9 is preferably for use in supporting long perforating gun strings, to prevent perforating guns 12 from sagging into contact with the interior surface 16 of the casing 18. For this purpose, the swivel device 22 is preferably connected between perforating guns 12.

Although the pressure isolating bulkheads 54 are not used between the end connectors 44, and the end connectors do not rotate independently of each other in the configuration of FIG. 9, it should be understood that the bulkheads and independently rotating end connectors (as described above for the configurations of FIGS. 7 & 8) could be used in this configuration, if desired.

Note that, as depicted in FIG. 9, the axis of rotation 24 and center axis 28 are aligned. However, the axis of rotation 24 and center axis 28 could be laterally offset if desired.

Figure 10:
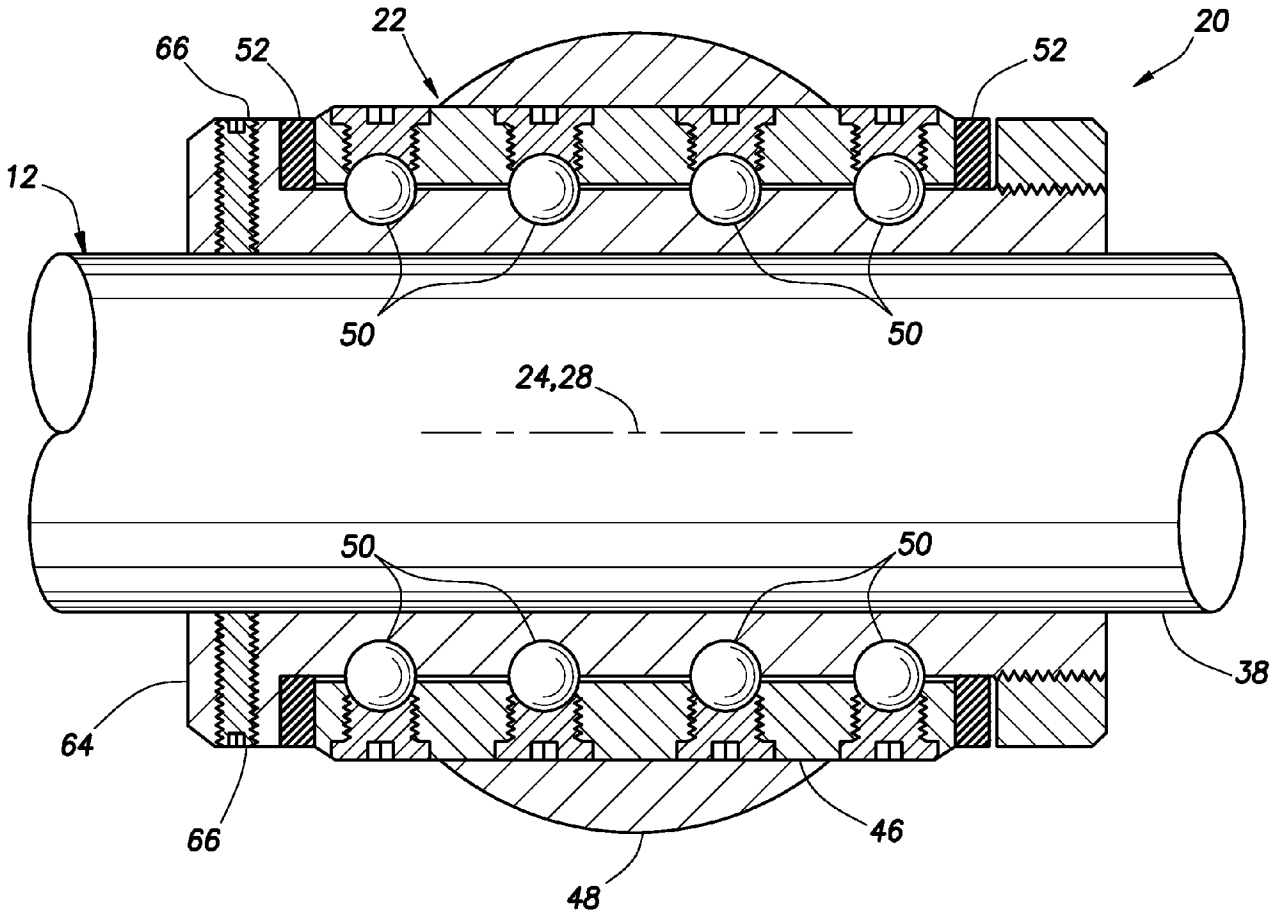
FIG. 10 is a schematic cross-sectional view of yet another alternate construction of the swivel device.

Referring additionally now to FIG. 10, yet another alternate configuration of the swivel device 22 is representatively illustrated. In this configuration, the swivel device 22 is connected to the perforating gun 12 by attaching it externally to the gun body 38 or another portion of the perforating gun.

The swivel device 22 could, for example, be attached to a portion of the perforating gun 12 which does not have perforating charges 10 therein. Alternatively, the swivel device could be attached to any connectors used between perforating guns 12.

An inner housing 64 of the swivel device 22 may be secured to the perforating gun 12 using set screws 66 or any other fastening means.

As with the swivel device 22 of FIG. 9, the swivel device configuration of FIG. 10 is preferably for use in supporting long perforating gun strings, to prevent perforating guns 12 from sagging into contact with the interior surface 16 of the casing 18. However, the swivel device 22 of FIG. 10 is not necessarily connected between perforating guns 12 or other components of a perforating string.

Note that, as depicted in FIG. 10, the axis of rotation 24 and center axis 28 are aligned. However, the axis of rotation 24 and center axis 28 could be laterally offset if desired.

Figure 11:
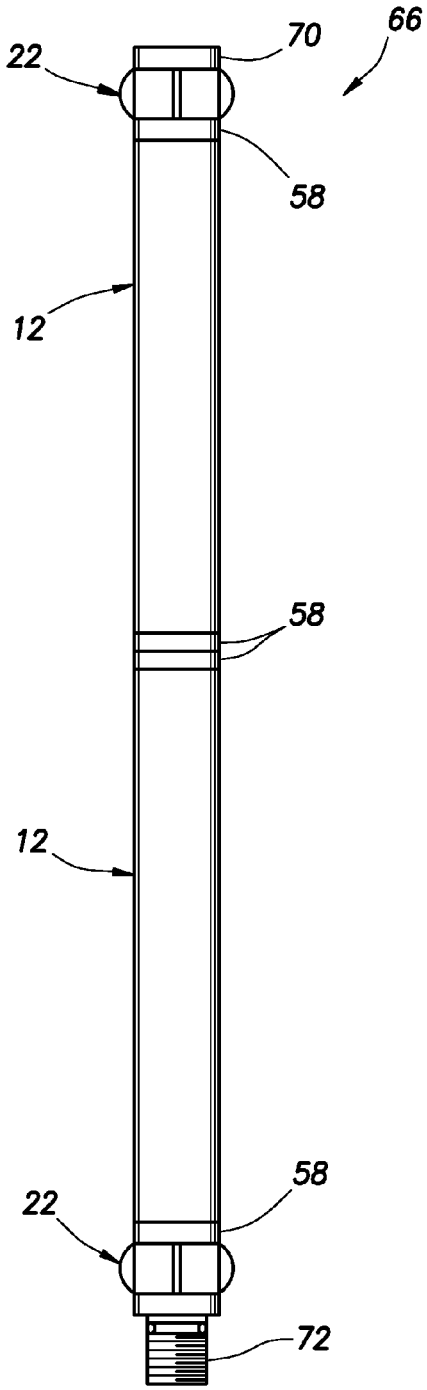
FIG. 11 is a schematic elevational view of a perforating gun and swivel device assembly.
Figure 12:
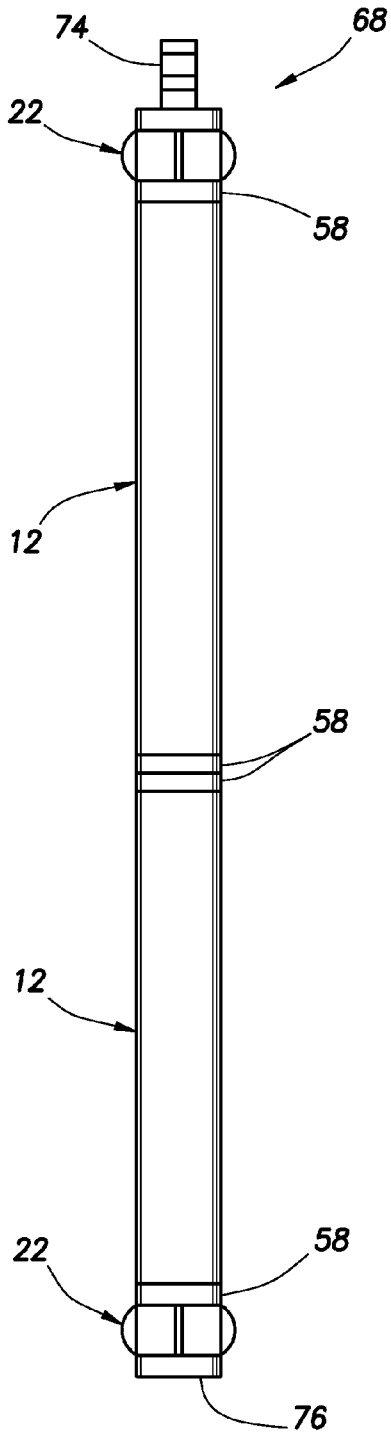
FIG. 12 is a schematic elevational view of an alternate configuration of the assembly of FIG. 11.

Referring additionally now to FIGS. 11 & 12, two assemblies 66, 68 of perforating guns 12 and swivel devices 22 are representatively illustrated. These assemblies 66, 68 are especially suited for use with automated rig handling equipment for efficient and convenient running of perforating gun strings.

In FIG. 11, two swivel devices 22 are depicted connected at opposite ends of two perforating guns 12, although it should be understood that any number of guns and swivel devices may be used as desired. At either end of the assembly 66 are "quick trip" connectors 70, 72 of the type which are suitable for threaded connection using automated rig handling equipment. Such connectors are well known to those skilled in the art and are not described further herein.

In FIG. 12, the assembly 68 is similarly configured, except that stab-in "auto latch" connectors 74, 76 are used at either end of the assembly 68. The connectors 74, 76 do not require threading to each other, but are also suitable for connection using automated rig handling equipment. Suitable connectors are described in U.S. Pat. No. 5,957,209, the entire disclosure of which is incorporated herein by this reference.

It may now be fully appreciated that the above disclosure provides many advancements in the art of oriented well perforating. In various examples of the orientation system 20, no long blank sections (e.g., for adding weight to one side of the string, etc.) are needed in a perforating string to accommodate the swivel devices 22, the system is able to use standard perforating guns 12 (thereby taking advantage of economies of scale, ease of loading standard guns, etc.), increased orientation accuracy is obtained, increased gun performance is achieved (e.g., due to centering, or at least supporting the guns, in the casing 18), and automated rig handling equipment may be used (thereby minimizing rig personnel presence on the rig floor while perforating guns are being installed).

A perforating gun gravitational orientation system 20 according to the above disclosure may include at least one perforating gun 12 and at least one swivel device 22 connected to the perforating gun to permit rotation of the perforating gun within a casing 18. The perforating gun 12 may be spaced apart from the casing 18 by the swivel device 22.

The perforating gun 12 may have a center of gravity 26, the swivel device 22 may have an axis of rotation 24, and the center of gravity may be spaced apart from the axis of rotation. The perforating gun 12 may have a center axis 28, and the gun center axis may be spaced apart from the axis of rotation 24.

Multiple swivel devices 22 may be connected to multiple perforating guns 12, with the swivel devices permitting independent rotation of the perforating guns within the casing 18.

The swivel device 22 may include a pressure isolating bulkhead 54 positioned between two detonation transfer components 56.

The swivel device 22 may be connected between multiple perforating guns 12. A perforating gun 12 may be connected between multiple swivel devices 22.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A perforating gun gravitational orientation system, comprising:

at least one perforating gun, including an external gun body which pressure isolates a charge carrier from a wellbore external to the gun body; and at least two swivel devices rotatably connected to the perforating gun, whereby the perforating gun rotates relative to a work string in response to gravity acting on the perforating gun within a casing, wherein the casing forms a protective wellbore lining and the swivel devices prevent contact between the external gun body and the casing.

2. The system of claim 1, wherein the swivel devices are connected to multiple perforating guns, whereby the swivel devices permit independent rotation of the perforating guns within the casing.

3. The system of claim 1, wherein at least one of the swivel devices includes a pressure isolating bulkhead positioned between two detonation transfer components.

4. The system of claim 1, wherein at least one of the swivel devices is connected between multiple perforating guns.

5. The system of claim 1, wherein the perforating gun is connected to more than two swivel devices.

* * * * *